United States Patent [19]

Akkerman

[11] 4,407,363

[45] Oct. 4, 1983

[54] SUBSURFACE WELL APPARATUS

[75] Inventor: Neil H. Akkerman, Kingwood, Tex.

[73] Assignees: AVA International, Houston, Tex.

[21] Appl. No.: 233,629

[22] Filed: Feb. 17, 1981

[51] Int. Cl.[3] ..... E21B 33/128; E21B 34/10; E21B 34/14

[52] U.S. Cl. ..... 166/183; 166/117.5; 166/188; 166/237; 166/321; 166/323; 166/332

[58] Field of Search ..... 166/117.5, 320–324, 166/332, 334, 212, 237, 319, 188, 183; 175/93

[56] References Cited

U.S. PATENT DOCUMENTS

| | | | |
|---|---|---|---|
| 1,747,398 | 2/1930 | Short | 175/93 X |
| 2,612,346 | 9/1952 | Nelson | 175/93 X |
| 3,071,151 | 1/1963 | Sizer | 166/324 X |
| 3,430,698 | 3/1969 | Urbanosky | 166/212 |
| 3,665,955 | 5/1972 | Conner, Sr. | 166/117.5 X |
| 3,958,633 | 5/1976 | Britch et al. | 166/117.5 |
| 4,066,128 | 1/1978 | Davis et al. | 166/117.5 X |
| 4,077,473 | 3/1978 | Watkins | 166/323 |
| 4,161,219 | 7/1979 | Pringle | 166/324 |
| 4,215,748 | 8/1980 | Pace et al. | 166/323 |

*Primary Examiner*—Stephen J. Novosad
*Attorney, Agent, or Firm*—Vaden, Eickenroht, Thompson, Bednar & Jamison; Vaden, Eickenroht, Thompson, Bednar & Jamison

[57] ABSTRACT

There is disclosed a subsurface well completion system comprising body means having a bore therethrough adapted to be connected in axial alignment with a tubing string suspended within a well bore, and a packer carried by the body means for closing off the annulus above a production zone of the well. Flow through each of the bore of the body means and a passageway within the body means which bypasses the packer to connect the annulus above and below the packer is controlled by safety valves having pressure responsive operators for moving such valves from normally closed to open positions by means of control fluid which is supplied thereto through a control line from a remote source. Upon loss of control fluid, as, for example, due to loss of the control line, the valves automatically close. The pressure responsive operator for the tubing safety valve is carried within a tool which is landed within and retrieved from an upper pocket in the body means to one side of its bore, and the pressure responsive operator for the annulus safety valve, as well as a means for supplying control fluid to a means for releasing the packer to be set, are carried within additional tools which are landed within and retrieved from a lower pocket therein. The tubing safety valve is moved to open position and held in open position irrespective of control fluid by means of still another tool which is landed in the upper pocket, when the tool carrying pressure responsive means for operating the tubing safety valve is removed therefrom, so that the annulus safety valve tool may be substituted in the lower pocket for the packer releasing tool, after the packer is set, without risk of severing the wire line on which such tools are run.

64 Claims, 16 Drawing Figures

23
20
LO
22
UM
38
21
23
WB
PR
25
24
30
26
31
32
30
27
PW
28
29
33
34
TS
P
Z

TS
LO
53
40
21
LM
32
27
TH
28
PC
35
GLV
P 23
20
LO
UM
38
ASV
24
WB
30
31
30
29
TH
TS
Z

TS
TSVO
22
38
21
25
30
26
32
27
33
34
35
GLV
P

SUBSURFACE WELL APPARATUS

This invention relates generally to improvements in apparatus which is remotely operable to move a part from one position to another and hold it in that other position, and is especially well suited for moving and holding a part disposed within a well bore in response to manipulation of a wire line or the like at the wellhead. For example, it may be used to move a valve closure member of a subsurface valve member from normally closed to open position and hold it in such open position, and, in one of its important aspects, relates to improvements in such apparatus for so moving and holding the closure member of a tubing safety valve which is, during normal safety conditions, held open by control fluid supplied to fluid responsive operator means for the valve through a control line in the annulus of the well about the tubing string, whereby, upon loss of control pressure, the valve automatically closed. In another of its aspects, it relates to improvements in a well completion system which includes, in addition to such a tubing safety valve, means for releasing a packer to be set in the well bore about the tubing string for closing off the annulus about the string, and safety valve means for opening and closing a passageway in the body means for connecting the annulus about the tubing string above and below the packer, when the packer is set, each such means being responsive to control fluid supplied through the control line.

My copending application, Ser. No. 168,435, filed July 10, 1980, and entitled "Flow Controlling Apparatus", now U.S. Pat. No. 4,325,431 discloses a tubing safety valve of the type described wherein the pressure responsive means for holding the closure member open is carried with a tool which is landed in a pocket to one side of a bore through a mandrel which is connected as part of the tubing string. The tool may be run on a wire line through the tubing string into and out of landed position within the pocket, whereby parts of the operating means including dynamic seals may be retrieved for replacement or repair.

It is often desired to hold open the closure member of a tubing safety valve of this general type, or even a valve of another type, in order that wire lines may be passed through it in the performance of operations within the well below the safety valve, and many operators of wells prefer not to rely on control fluid for holding the safety valve open, because, in the event control fluid is lost, or the control system malfunctions in some way, the wire line would be severed by the closure member. Furthermore, it is also obvious that there are many other operations to be performed within a well which require that another part, such as, for example, a shiftable sleeve or latch, be moved from one position to another and held in that other position in response to some remote operation.

It has heretofore been proposed to provide means of different types for locking a tubing safety valve in open position, usually in response to a wire line manipulation. In some cases, however, the tubing safety valves are permanently locked open—i.e., it's impossible to subsequently permit them to be closed, and thus to operate in their intended fashion in the event of loss of control fluid. In other cases, control fluid must be supplied through two control lines, which of course increases the cost of the system as well as the likelihood of failure.

It has also been proposed to lock the safety valve open by a means which automatically resets to close the safety valve in response to control pressure, and, which, would therefore be particularly unsuitable in the completion system of my invention. Thus, in a somewhat analogous sense, the tubing safety valve of my aforementioned copending application, Ser. No. 168,435, now U.S. Pat. No. 4,325,431 will hold the safety valve open as long as control pressure is supplied to its operating means, but upon loss of that control pressure, for any reason, will automatically permit the safety valve closure member to return to close position. As will be explained hereinafter, this inability to hold the closure member open irrespective of control pressure makes it impossible for the tubing safety valve to be used in the system. Although it has further been proposed to provide a means for holding a tubing safety valve open irrespective of control pressure, apparatus of this type becomes a permanent installation which cannot be removed, once installed. Consequently, it could not be used for this reason alone if it were desired to hold the valve open by a tool which would as part of the system described in my copending application be installed in a side pocket in the place of the safety valve operating tool.

My copending application, Ser. No. 233,628, filed Feb. 17, 1981, and entitled "Flow Controlling Apparatus", discloses subsurface well apparatus of the type above mentioned in which a downward continuation of the body means connected as part of the tubing string in which the tubing safety valve is mounted carries a packer for closing off the annulus between the tubing string and the well bore, and a means is provided including a passageway through the body means for connecting the annulus above the packer with the annulus below the packer. More particularly, the body means includes a mandrel having a pocket to one side of and opening to the bore of the body means beneath the tubing safety valve and adapted to land a tool which connects a downward continuation of the tubing safety valve control line with the passageway to permit control fluid to be supplied to a pressure responsive means which closes the passageway for releasing the packer to be set, and, upon release and setting of the packer as well as removal of the packer releasing means from within the passageway, to open it. Upon retrieval of the packer releasing tool, another tool may be landed in the pocket which carries safety valve means for controlling flow through the passageway between the annulus above and below the packer in response to the supply of control fluid thereto through the same downward continuation of the control line.

Inasmuch as a well completion system of this type requires removal from and replacement within the lower pocket of the packer releasing tool with the annulus safety valve tool, the tubing safety valve must of course be held open so that it will not sever the wire line on which the tools are run. However, as noted, the tubing safety valve is inherently incapable of holding the tubing safety valve open for this purpose since it is reponsive to control line fluid which would be lost upon removal of either the packer releasing tool or the annulus safety valve tool from the lower pocket.

It is therefore an object of the present invention to provide a means for holding a part to be moved from one position to another, and held in such position—whether such part is the closure member of the above-described tubing safety valve or another part in the well bore—which apparatus overcomes the shortcomings of the aforementioned prior held open apparatus.

It is another object to provide a hold-open tool which is insensitive to control line pressure so that, in the above-described well completion system, it may be landed in the pocket which receives the tubing safety valve operating tool, when such operating tool is removed therefrom, and, upon activation, move the closure member of the tubing safety valve to open position in the same manner that it is so moved by the tubing safety valve operator, but with the assurance that it will be held in such position whether or not control fluid is lost or the control line otherwise malfunctions.

A further object is to provide apparatus of this type which, in response to a remote operation of some type, is moved from inactive to active position by means of a self-contained source of pressure fluid, or by means of ambient pressure, or by means of either such pressure depending on which is predominant, and in which the tool may be removed from its subsurface well location, such as a side pocket mandrel, to permit the part which has been moved into and held in a certain position to return to its original position, as in the case of a tubing safety valve; and, more particularly, which, because of its insensitivity to control pressure, does not cause the safety valve closure member or other part being actuated to be reset or to return to its original position upon loss of control line pressure.

These and other objects are accomplished in accordance with the illustrated embodiments of the invention, by subsurface well apparatus which comprises body means, which may be disposable within a well bore and include a tool landable within a pocket of an outer body, as in the case of the subsurface apparatus previously described, the tool having first and second chambers therein, an actuator sealably reciprocable within the first chamber for shifting between inactive and active positions, a source of fluid contained within the second chamber, and a valve means shiftable within the body means between a first position in which it prevents communication between the first and second chambers, and a second position in which it establishes communication between them so that the pressure from the source in the first chamber is effective to urge the actuator from inactive to active position. More particularly, the valve means is held in its first position by a running tool which is releasably connected to the body, and is caused to shift to its second position in response to a remote operation, such as manipulation of the wire line connected to the running tool, to shear the releasable connection of the running tool to the well tool.

A means is also provided for admitting ambient pressure to a first chamber when it exceeds the pressure fluid contained in the second chamber, whereby the ambient pressure is effective over the pressure responsive member in the first chamber to shift the actuator from inactive to active positions. The valve means comprises a rod which is slidable within the body means to act as a sleeve valve in opening and closing fluid communication between the first and second chambers. More particularly, the actuator includes a piston which has a tubular extension extending inwardly within the first pressure chamber, and one end of the rod fits wihin the extension when the valve is in its first position and the actuator is in its inactive position, but is moved from the extension when valve means moves to its second position to admit pressure fluid to the second chamber to move the actuator to active position.

More particularly, first and second means are provided for sealing between respectively larger and smaller diameter portions of the actuator and the body means to define a first atmospheric chamber, a third means is provided for sealing between the rod and a diameter portion of the tubular extension of the actuator which is smaller than the second diameter portion, and a fourth means is provided for sealing between the rod and the body means so as to define another atmospheric chamber between the body, rod, and actuator. Upon release of the means holding the rod in its first position, to permit the rod to be urged toward its second position, the third means is withdrawn from sealing engagement with the actuator to open the atmospheric chambers to pressure within the first pressure chamber. More particularly, the arrangement of seal means is such that when the valve means is in its inactive position, ambient pressure will urge it toward such position, but when it is moved to its second position, ambient pressure or the source of contained pressure whichever is predominant, urges the actuator to active position with a relatively large force.

As previously described, when used to hold upon the tubing safety valve of my copending application, Ser. No. 168,435, now U.S. Pat. No. 4,325,431 the apparatus comprises a tool which is adapted to be landed within the side pocket in the mandrel in which the tubing safety valve operator tool is landed during normal safety conditions. For this purpose, the actuator of the lock-open tool of this invention comprises a plunger which is adapted to extend in order to move the safety valve to open position in the same manner as a plunger of the tubing safety valve operator extends to so move the safety valve.

Thus, and as previously mentioned, the lock-open tool is insensitive to control line pressure, so that it will remain in its active position to hold the tubing safety valve open even while the packer releasing tool is removed from the pocket of a mandrel and replaced with the annulus safety valve tool. More particularly, the use of such a lock-open tool in the well completion system of the present invention enables the tubing safety valve, the packer releasing means and the annulus safety valve to be operated in response to control fluid supplied thereto through a single line leading from the same source, with the assurance that the tools necessary to install the system may be run through the tubing safety valve, as required, without shearing the wire line on which they are so run.

In the drawings, wherein like reference characters are used throughout to designate like parts:

FIG. 1 is a vertical sectional view of body means having a bore therethrough connected as part of a tubing string, including a mandrel having a subsurface safety valve closure member which is adapted to be moved between positions for opening and closing the bore, and with the tool for locking the closure member in open position lowered by means of a wire line running tool into landed position within a pocket in the mandrel to one side of the bore;

FIG. 2 is a vertical sectional view similar to FIG. 1, but with the running tool removed from the tool so as to cause a plunger to be extended from the lower end of the tool in order to move the closure member into and hold it in its open position;

FIG. 3 is a further vertical sectional view similar to FIGS. 1 and 2, but with the hold-open tool removed from the mandrel side pocket, and another tool landed therein for the purpose of moving the safety valve closure member from its normally closed to its open position in response to the supply of control fluid to an operating means within the tool through a control line leading from the wellhead;

Figure 3:
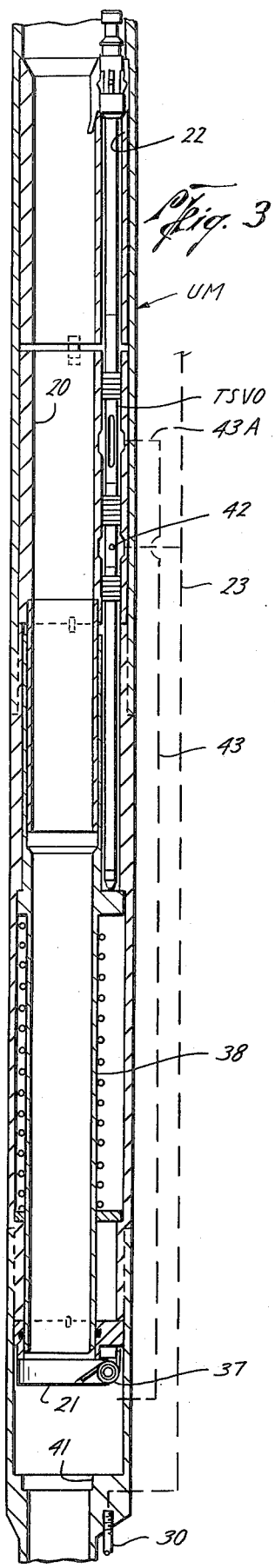
Figure 1:
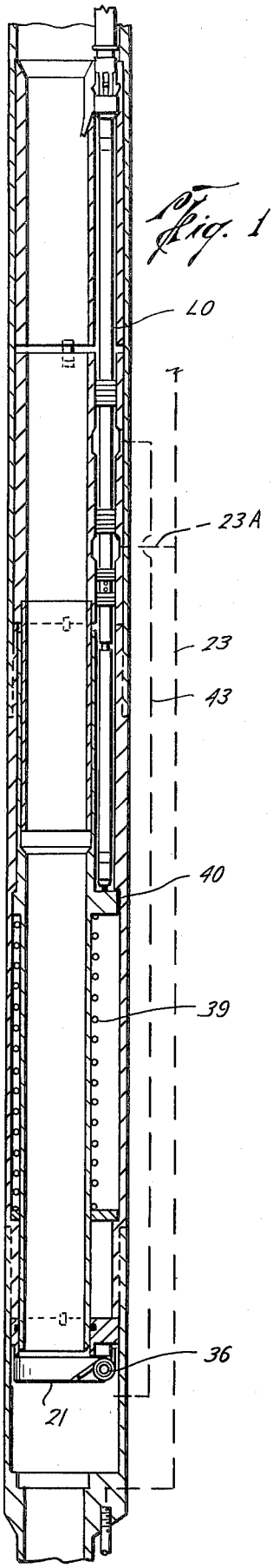
Figure 2:
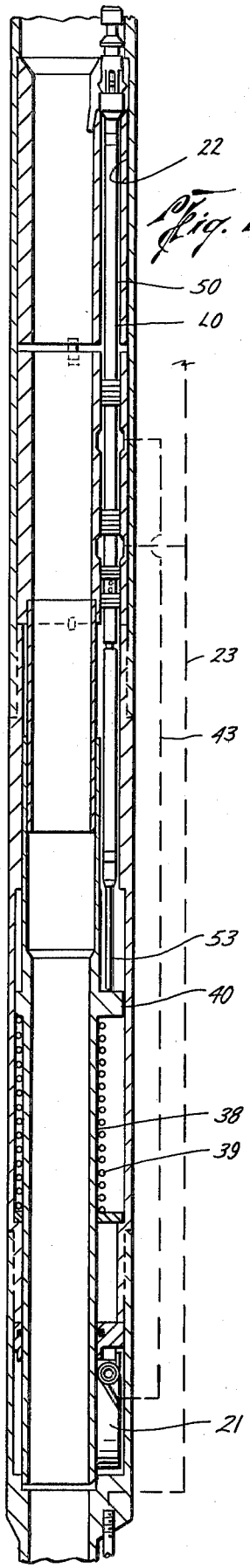
Figure 8:
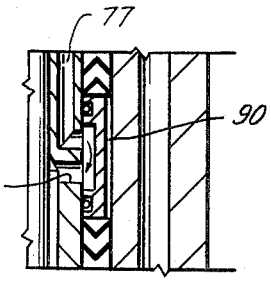
Figures 9, 10, 11, 12:
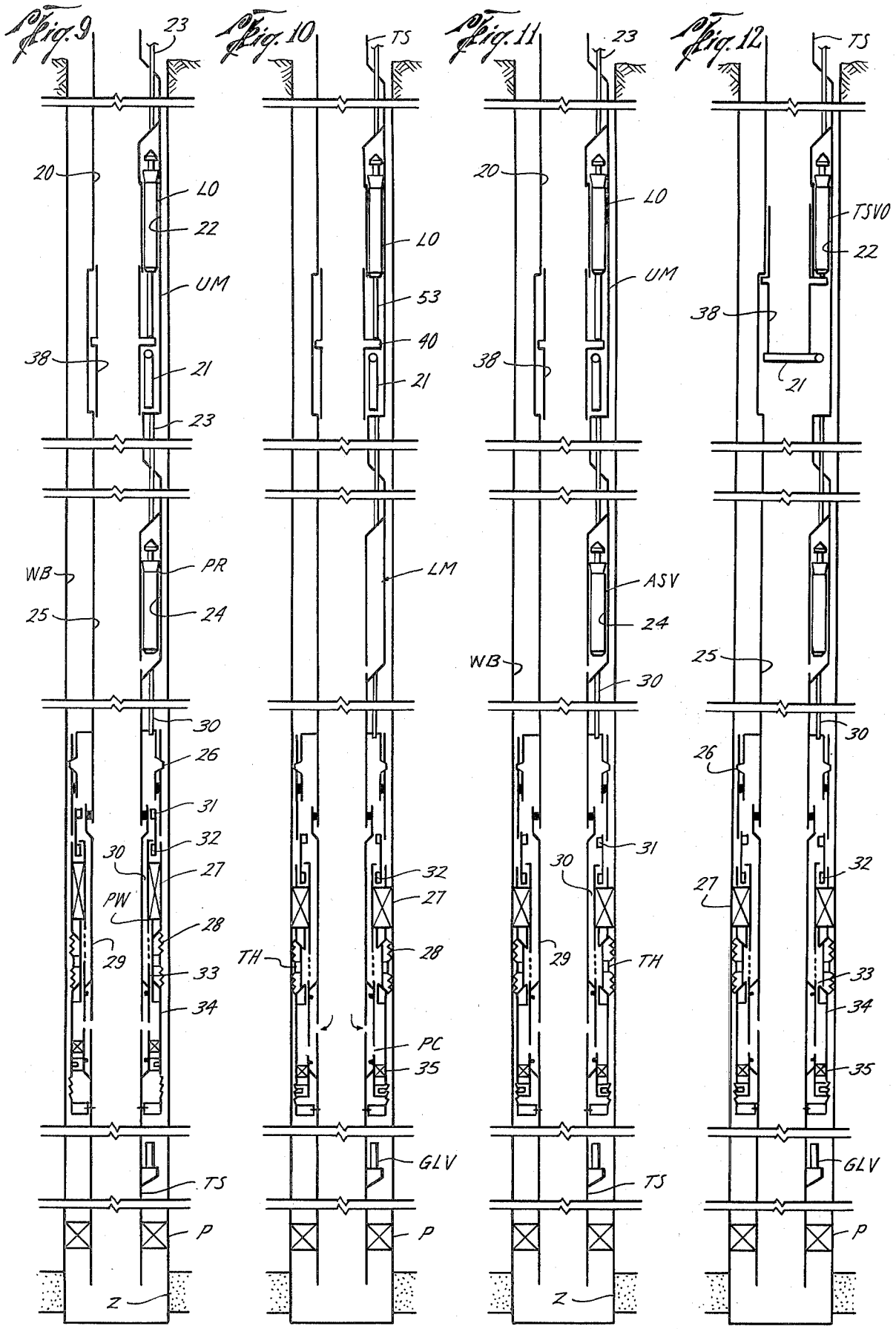

FIG. 8 is another detailed view of a tool identical to the tool of FIGS. 4A–4C and 5A–5C, except for a modification which enables the tool to be actuated regardless of whether it is sealably landed within the mandrel pocket; and FIGS. 9, 10, 11 and 12 are diagrammatic illustrations of the body means of FIGS. 1 to 3 connected as part of a tubing string suspended within a well bore, and including the mandrel adapted to receive either the lock-open tool or the operating tool of the tubing safety valve, as well as a downward continuation of the body means which includes a tubing hanger having a packer for closing off the annulus between the tubing string and the well bore, together with a mandrel above the tubing string having a side pocket to receive either a tool for supplying control fluid from the control line to a means for releasing the packer to be set, or a tool having valve means for opening a normally closed passageway in the body means for connecting the annulus above the packer with the annulus below the packer, in response to the supply of such control fluid to an operator for the valve means; FIG. 9 showing the lock-open tool installed in the pocket of the upper mandrel and actuated to hold the tubing safety valve closure member in open position, and the packer releasing tool installed in the pocket of the lower mandrel preparatory to releasing the packer to be set; FIG. 10 showing the packer released, following the supply thereto of control fluid through the packer releasing tool, and the packer expanded to set position by means of tubing pressure, as indicated by the arrows of FIG. 10; and with the packer releasing tool removed from the lower side pocket mandrel and retrieved through the locked open tubing safety valve; FIG. 11 showing the annulus safety valve tool installed within the pocket of the lower mandrel in order to control the circulation of well fluid between the annulus above and below the set packer; and FIG. 12 showing the tubing safety valve lock-open tool removed from the pocket of the upper mandrel, and the tool for operating the tubing safety valve installed therein in order to permit the tubing safety valve to be reopened in response to the supply of control fluid through the control line.

With reference now to the details of the above-described drawings, the overall tubing safety valve shown in FIGS. 1, 2 and 3 includes an upper mandrel UM connected as part of the tubing string TS shown in FIGS. 9–12 to be suspended within a well bore WB, also shown in FIGS. 9–12. The upper mandrel UM has a bore 20 therethrough which is axially aligned with tubing string, when connected as a part thereof, as shown in FIGS. 9–12, and a closure member 21 is carried by the mandrel for movement between a position opening the bore (FIGS. 2 and 9–11) and a position closing the bore (FIGS. 1, 3 and 12). A pocket 22 is formed in the mandrel to one side of the bore 20 and has an open upper end which connects with the bore so as to receive either the lock-open tool LO shown in FIGS. 1, 2, 9, 10 and 11, or the tubing safety valve operating tool TSVO, as shown in FIGS. 3 and 12.

As previously mentioned, and as will be described in detail to follow, the lock-open tool LO is of such construction that when the plunger thereof is extended from the inactive position of FIG. 1 to the active position of FIG. 2, it will move the tubing safety valve 21 from closed to open position and then hold it in open position until the tool LO has been removed from the side pocket mandrel 22. As also previously mentioned, when the purposes for locking the tubing safety valve has been served, and the lock-open tool LO is removed from the mandrel 22, the tubing safety valve operating tool TSVO is installed in such mandrel for the purpose of moving the safety valve 21 from the closed position of FIGS. 3 and 12 to its open position in response to the supply of control fluid thereto through a control line 23 indicated diagrammatically by broken lines in FIGS. 1, 2 and 3.

As also shown in FIGS. 9 to 12, as well as at the bottom of FIGS. 1, 2 and 3, control line 23 is continued downwardly from the upper mandrel UM for connection with a side pocket 24 formed within a lower mandrel LM beneath the upper mandrel UM and which has a bore 25 therethrough coaxially arranged with respect to the bore 20 through the upper mandrel UM. As in the case of the upper mandrel, the side pocket 24 of the upper mandrel is disposed to one side of bore 25 and has an upper end which opens to it so that either the packer releasing tool PR or the annulus safety valve tool ASV may be landed therein. As described, the tubing safety valve 21 is held in open position during this selective installation and retrieval of the packer releasing tool and annulus safety valve tool by virtue of the fact that the tool LO is insensitive to control fluid, and thus whether or not a tool is within pocket 24.

The downward continuation of the body means also includes a tubing hanger TH having a packing element 27 and a slip assembly 28 carried thereby. More particularly, and as described in detail in my aforementioned application Ser. No. 233,628, filed Feb. 17, 1981, and entitled "Flow Controlling Apparatus", the lower end of the lower mandrel LM is connected to the tubing hanger TH by a suitable locking means 26. When the mandrel and tubing hanger are so connected, the bore 29 through a tubular member 30 of the tubing hanger, which is connected at its lower end to the lower portion of the tubing string TS, is axially aligned with the bore 25 through the lower mandrel LM and thus with the bore 20 through the upper mandrel UM. The lower portion of the the tubing string is packed off at P within the well bore above a producing zone Z which is penetrated by the well bore. The well bore may be an open hole or it may be cased, and one or more gas lift valves GLV are installed in the tubing string intermediate the packers 27 and P, for a purpose which is described in my copending application Ser. No. 233,628, filed Feb. 17, 1981, and entitled "Flow Controlling Apparatus".

As also described in my copending application Ser. No. 233,628, filed Feb. 17, 1981, and entitled "Flow Controlling Apparatus", when the packer releasing tool PR is installed in pocket 24, control fluid supplied through control line 23 will pass into a passageway PW which, when open, connects the annulus about the tubing string above packer 27 with the annulus therebelow. For this purpose, a tube 30 connects the control line 23 extending within the upper mandrel to the pocket 24 and thus through the releasing tool PR to the upper end of a piston 31 which, with the packer locked in unset position, closes the passageway PW, as indicated diagrammatically in FIG. 9.

In this position of the piston, a sleeve 32 on its lower end holds a packer expanding sleeve 33 of the packer in a locked position with respect to the tubular member 30 thereof, thus preventing telescoping movement of the sleeve 33 with respect to another sleeve 34 of the packer in order to expand the packer as well as the slip elements to the positions of FIGS. 10, 11 and 12. However, when control fluid is applied to the piston 31, the sleeve 32 will be lowered to release the locking mechanism between the sleeve 33 and the tubular member, so that tubing pressure may be applied to a pressure chamber PC and thus to the upper side of a piston 35 on sleeve 33 in order to move the sleeve 33 downwardly with respect to the sleeve 34 which is held against upward movement with respect to the tubular member, and thereby expand the packing element and slip assembly. As also shown diagrammatically in FIGS. 10 to 12, lowering of the sleeve 33 and setting of the packer will cause the piston 31 to be moved out of the passageway PW and open it to circulation of well fluid between the annulus above and below the packer.

Then, upon removal of the packer releasing tool PR, as shown in FIG. 10, and installation into the pocket 24 of the annulus safety valve tool ASV, as shown in FIG. 11, control fluid supplied to the control line 23 will open a safety valve with such tool, as described in my aforementioned copending application Ser. No. 233,628, filed Feb. 17, 1981, and entitled "Flow Controlling Apparatus", so as to establish circulation between the annulus above the packer and the annulus below the packer. Thus, gas may be circulated downwardly through the annulus, through the safety valve, and the passageway PW into the annulus below the packer, and thus through the gas lift valve GLV into the tubing string in order to stimulate production from zone Z.

As will be seen from a comparison of FIGS. 11 and 12, with the annulus safety valve tool in place, the lock-open tool LO may be retrieved from the pocket 24 of upper mandrel UM and the tubing safety valve operating tool installed therein, thus preparing each of the tubing and the annulus for safety valve control. In this respect, there's no need, at this stage, to maintain the tubing safety valve 21 open, because interchange of the tools in the pocket 24 does not require that wire line or other operations be conducted through the tubing safety valve. Then, of course, once the tubing safety valve operating tool is in place, and control fluid is supplied through the control line 23, both the tubing safety valve 21 and the annulus safety valve will be moved to open positions, and will remain in such positions until control line pressure is lost or removed, in which case both the tubing safety valve and the annulus safety valve will automatically close.

The tubing safety valve 21 is shown in each of FIGS. 1, 2 and 3 to comprise a flapper which pivots about a pin 36 mounted on the mandrel to one side of the bore through the upper mandrel between the closed positions of FIGS. 1 and 3 and the open position of FIG. 2. The flapper is urged toward the closed position by means of a torsion spring 37 acting between it and the mandrel, and the flapper is moved from its normally closed to its open position by means of a flow tube 38 which is coaxially reciprocable within the mandrel. More particularly, the flow tube is urged upwardly by a coil spring 39 acting between the mandrel and a flange 40 about the flow tube in order to raise its lower end above the closed flapper. Then, as the flow tube is moved downwardly to compress the spring 39, its lower end will engage and swing the flapper downwardly to the open position of FIG. 2, the lower end of the flow tube then extending into a counterbore 41 in the lower end of the mandrel to form a smooth continuation of the bore 20 therethrough. When the downward force of the plunger which was applied to the flow tube to lower it is relieved, the tube will rise to permit torsion spring 36 to automatically return the flapper 21 to its closed position.

As described in my copending application, Ser. No. 168,435, filed July 10, 1980, and entitled "Flow Controlling Apparatus", now U.S. Pat. No. 4,325,431 the tool TSV for operating the tubing safety valve—i.e., holding it in open position by means of control line pressure—includes a plunger which, in the closed position of the valve, is retracted within the body of the tool, but which, in response to the supply of control fluid through the line 23 into the side port 42 in the tubing safety valve of operating tool, is extended to lower the flange 40 in order to lower the flow tube and thus open the flapper. As disclosed in my copending application, Ser. No. 168,435, filed July 10, 1980, and entitled "Flow Controlling Apparatus", now U.S. Pat. No. 4,325,431 the lower end of the upper portion of the control line 23 connects with passageways formed within the mandrel which connect with a pressure chamber within the tubing safety valve operating tool including a reciprocable piston on the upper end of the plunger.

Passageway 23 extends downwardly from its connection to the pocket in the upper mandrel so as to connect with passageways in the lower mandrel LM leading to the pocket 24 therein. Additional passageways, indicated diagrammatically at 43 in FIGS. 1, 2 and 3, connect the bore of the mandrel beneath the flapper with passageways in the tubing safety valve operating tool which in turn connect with the bore of the mandrel above the flapper, and additional valve means are mounted within the tubing safety valve operating tool for opening these passageways so as to equalize pressure across the closed flapper in the process of extending the plunger to lower the flow tube. Details of this arrangement are of course described in my copending application, Ser. No. 168,435, filed July 10, 1980, and entitled "Flow Controlling Apparatus".

As also described in my copending application, Ser. No. 168,435, filed July 10, 1980, and entitled "Flow Controlling Apparatus", now U.S. Pat. No. 4,325,431 the upper mandrel UM as well as the lower mandrel LM include a portion whose outer diameter is eccentric to the bore through the mandrel, and the pocket of each mandrel is formed in the thickened wall portion resulting from this eccentric arrangement. Preferably, the passageways connecting the control line 23 with the pocket of each mandrel, as well as those connecting the pocket with the exterior of the mandrel, either within or without the tubing string, are also formed in the thickened wall portion, and reference is again made to the detailed descriptions of my copending application, Ser. No. 168,435, filed July 10, 1980, and entitled "Flow Controlling Apparatus", now U.S. Pat. No. 4,325,431 and my copending application, Ser. No. 233,628, filed Feb. 17, 1981, and entitled "Flow Controlling Apparatus".

Figure 7:
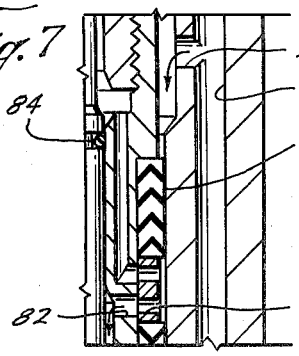
FIG. 7 is a detailed sectional view of a portion of a tool identical to that shown in FIGS. 4A–4C and 5A–5C, except for a modification which permits the plunger to be extended, if desired, by means of control fluid supplied thereto through the control line.

As shown in FIGS. 4A–4C and 5A–5C, the pocket 22 is intersected intermediate its upper and lower ends by means of a lateral extension 23A of the control fluid passageway 23, and a lateral extension 43A at the upper end of the equalizing passageway 43. The functions and purposes of these connections in connection with the tool TSVO has been previously mentioned, and is of course described in detail in my aforementioned copending applications. The location of the intersections of the passageways of the extensions 23A and 43A with the pocket 22 is important, insofar as the lock-open tool LO is concerned, in that they are closed off by suitable seal means carried by the tool, or insofar as the alternative embodiment of FIG. 7 is concerned, in that the seal means on such alternative lock-open tool is arranged to permit movement of the plunger of the tool from inactive to active position in response to control fluid through the control line 23, should that be desired.

Each embodiment of the lock-open tool comprises an outer body 50 which is hollow from one end to the other and includes an enlarged inner diameter portion 51 at its lower end and an elongate passageway 52 connecting the enlarged portion of the chamber with the open upper end of the body. An actuator in the form of a plunger 53 is axially reciprocable within the enlarged portion 51 between the inactive, withdrawn position of FIGS. 4A–4C and the active, extended positions of FIGS. 5A–5C, and a rod 54 is guidably reciprocable within the passageway 52 between the lower position of FIGS. 4A–4C and the upper position of FIGS. 5A–5C. Thus, a first pressure chamber PC-1 is formed within hollow portion 51 of the body intermediate the plunger and the rod, and, as will be understood from the description to follow, in reciprocating between these alternate positions, the rod acts as a spool valve in admitting pressure fluid from another chamber PC-2 in the body to the pressure chamber PC-1 in response to raising of the rod. Pressure fluid from chamber PC-2, or, as will also be described, ambient pressure acts over the upper end of the plunger 53 to move from its inactive to its active position.

As will be understood from FIGS. 1, 2, 4A–4C, and 5A–5C, when the plunger is in its withdrawn, inactive position, its lower end will be spaced just above the flange 40 on the flow tube 38. Consequently, the flow tube is fully raised by the coil spring 39 to permit the flapper 21 to close. However, when the flapper is moved downwardly in response to operating fluid within chamber PC-1, as will be described, it is moved downwardly against the flange 40 to move the tubing safety valve to open position. In this respect, the plunger is similar to the plunger of the tubing safety valve operating tool TSVO, as described in my aforementioned copending application, Ser. No. 168,435, filed July 10, 1980, and entitled "Flow Controlling Apparatus", now U.S. Pat. No. 4,325,431. As will also be described, when moved to its extended position, the plunger is locked against movement back to its withdrawn position so as to hold the safety valve open until the lock-open tool LO is removed from the pocket of the upper mandrel.

The body of the locking tool has a shoulder 54A thereabout which engages a seat 55 in the upper end of the pocket to land the tool in the pocket. When so landed, the tool is pressure balanced insofar as tubing pressure is concerned, as will be described to follow. Furthermore, its accidental movement upwardly is limited by means of locking dogs 56 carried about it for fitting within a recess 57 within the mandrel above the pocket. In order to retrieve the tool from the pocket, the locking dogs need only be lifted upwardly to permit them to move into a recess 58 about the body, and thus be raised above recess 57 in the mandrel. This releasable locking mechanism may be of any well known construction.

The upper head 59 of the body is enlarged above a neck 60 so as to permit its connection to a releasable running tool RT by means of a shear ring 61. The lock-open tool LO is lowered on a wire line connected to the running tool RT, so that, upon release of the running tool from the lock-open tool by shearing of ring 61 and lifting of the wire line, the head 59 and fishing neck 60 are free to be grasped by a suitable retrieving tool run on a wire line, the construction of which may be of any conventional type. The running tool RT carries a screw 62 whose lower end engages the upper end of rod 54 so as to lower the rod to the position of FIGS. 4A–4C, and hold it in such position as the tool LO is landed in the pocket of the upper mandrel and prior to release of the running tool RT.

When the rod is in its lower position, an intermediate reduced inner diameter portion 52A of passageway 52 is sealably engaged by an O-ring 62A carried about the rod 54, and another O-ring 63 carried by the rod is sealably engageable with an upper reduced portion 52B of the passageway 52. The pressure chamber PC-2 thus formed in the annular space about the rod vertically intermediate O-rings 62A and 63 is closed when the rod is in its lower position so as to contain a source of pressure fluid therein, which may be nitrogen or some other suitable gas at the pressure required to provide the force necessary to move the plunger from its inactive to its active position upon admission to chamber PC-1, as will be described to follow.

Figure 4A:
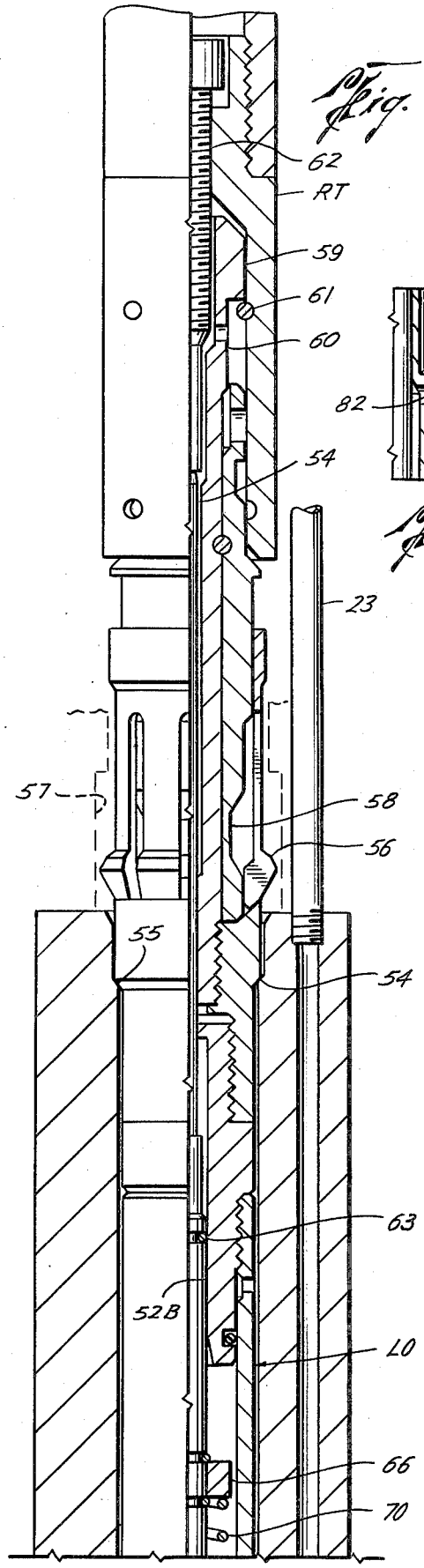
FIGS. 4A, 4B and 4C are enlarged views, partly in section and partly in elevation, of the hold-open tool landed within the side pocket of the mandrel, as shown in FIG. 1.
Figure 4B:
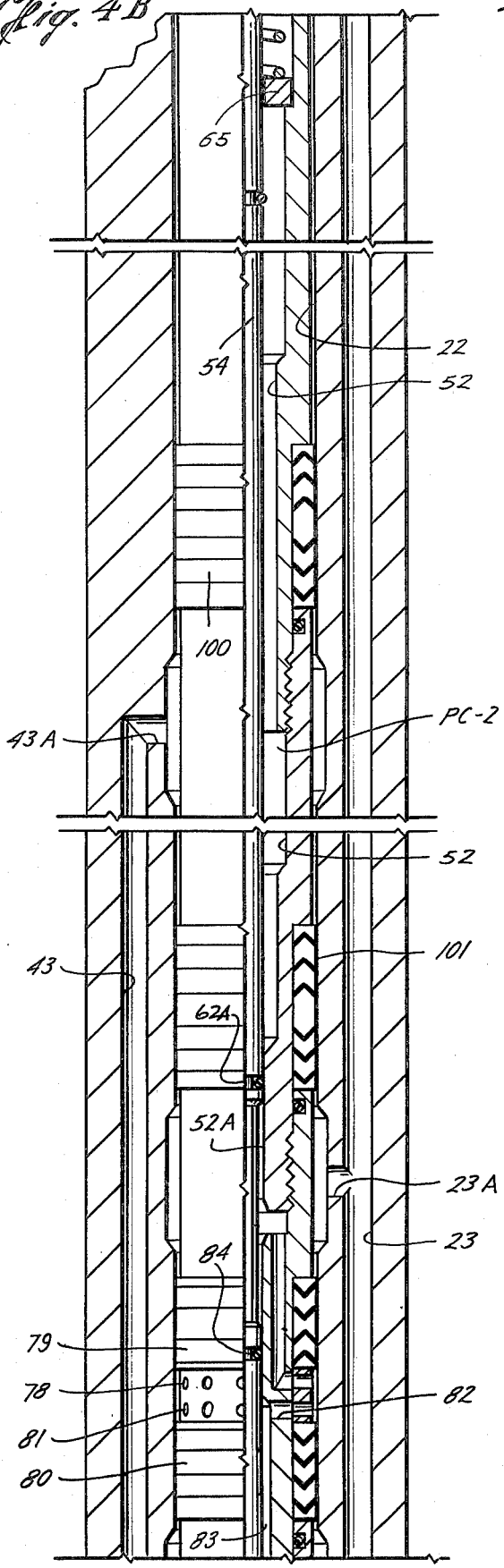
Figure 4C:
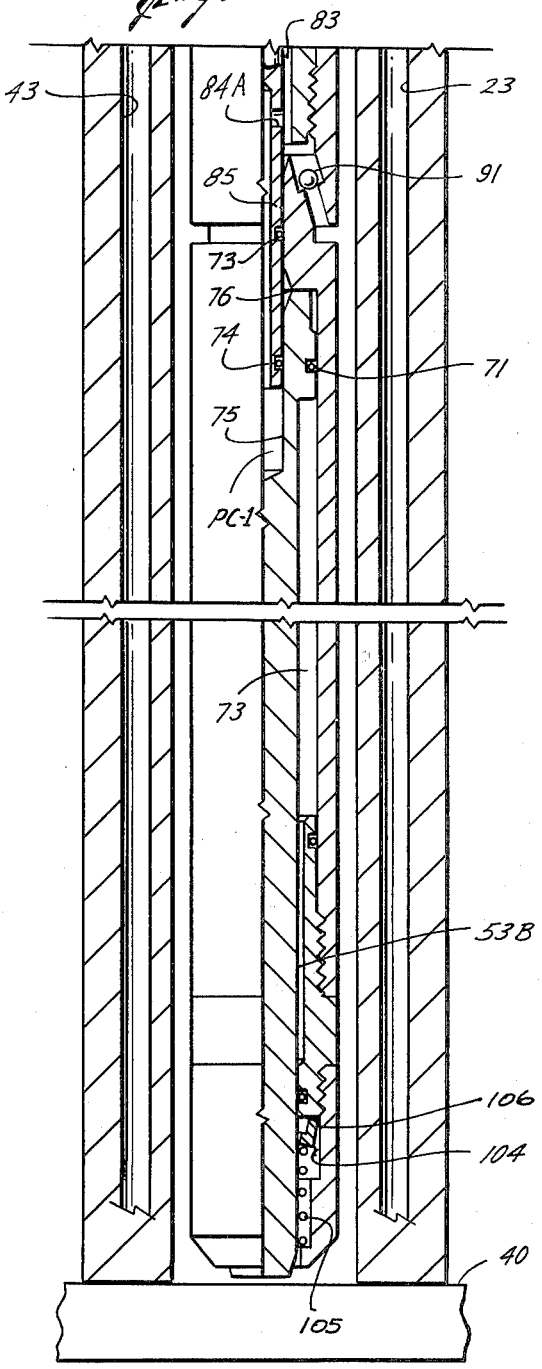

A coil spring 70 disposed within the chamber PC-2 is compressed between a ring 65 on the inside of the outer body of the tool and a ring 66 carried about the rod so as to urge the rod toward its upper position. When the rod is held in its lower position, as shown in FIGS. 4A–4C, the ring 66 of the rod is spaced beneath the upper end of the chamber so that, upon release of the running tool RT from the lock-open tool, the rod 54 is automatically moved upwardly to its upward position. In a manner to be described, upward shifting of the rod opens the chamber PC-2 to the pressure chamber PC-1 so that the pressurized gas acts on the plunger 53 to urge it to its lower position.

Figure 5A:
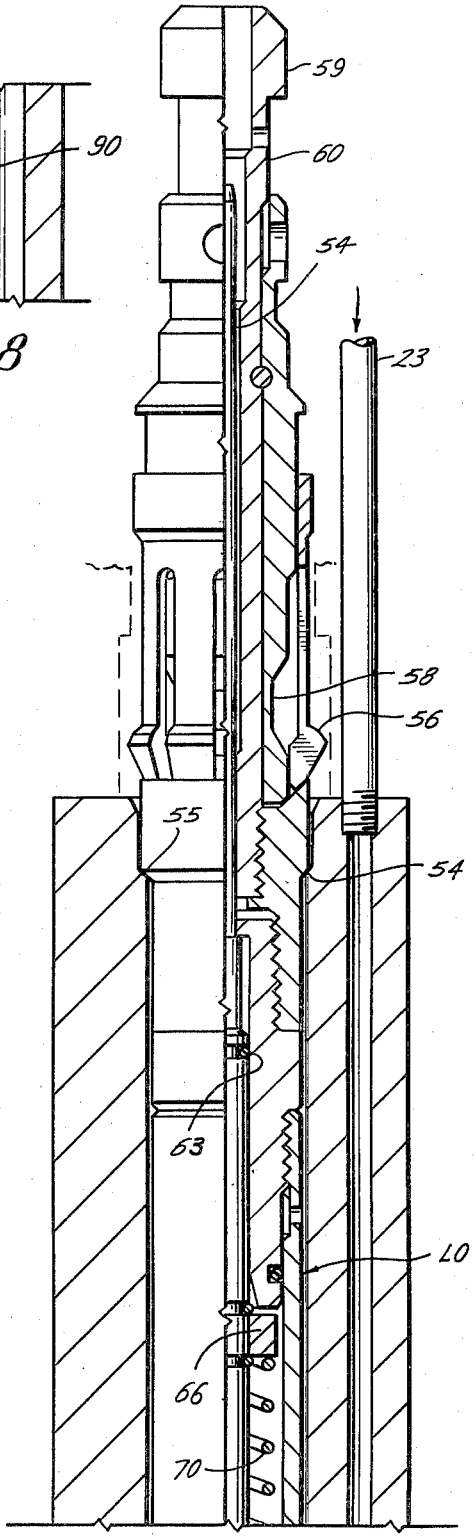
FIGS. 5A, 5B and 5C are views of the tool and mandrel similar to FIGS. 4A, 4B and 4C, but with the running tool removed from the upper end of the tool, as shown in FIG. 2, so as to cause the plunger thereof to be extended in order to lower the actuator tube within the bore of the mandrel in order to move the safety valve into and hold it in its open position.
Figure 5B:
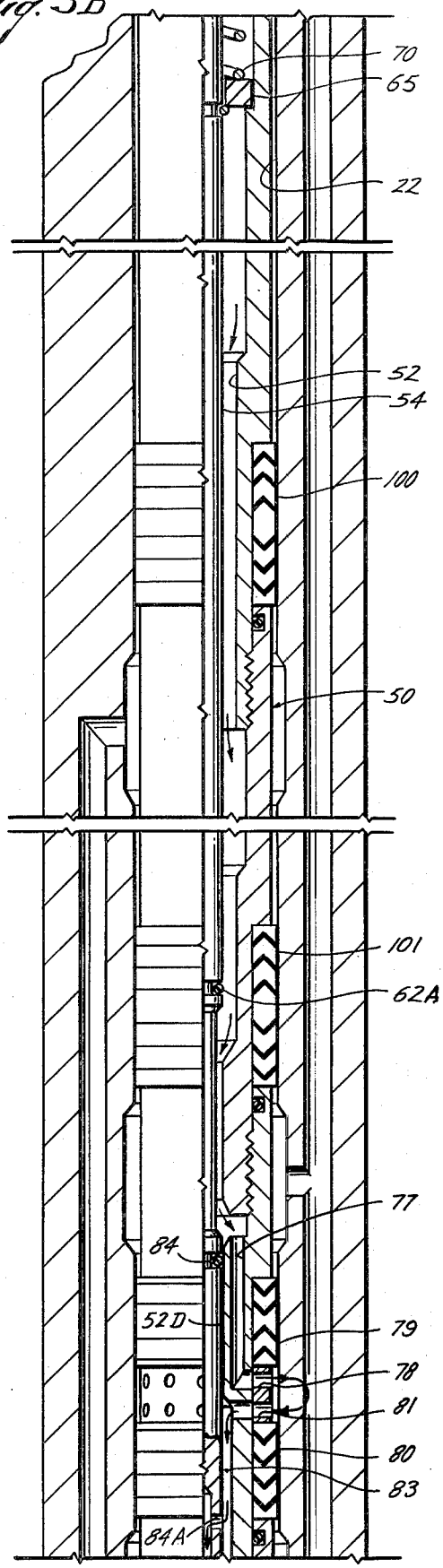
Figure 5C:
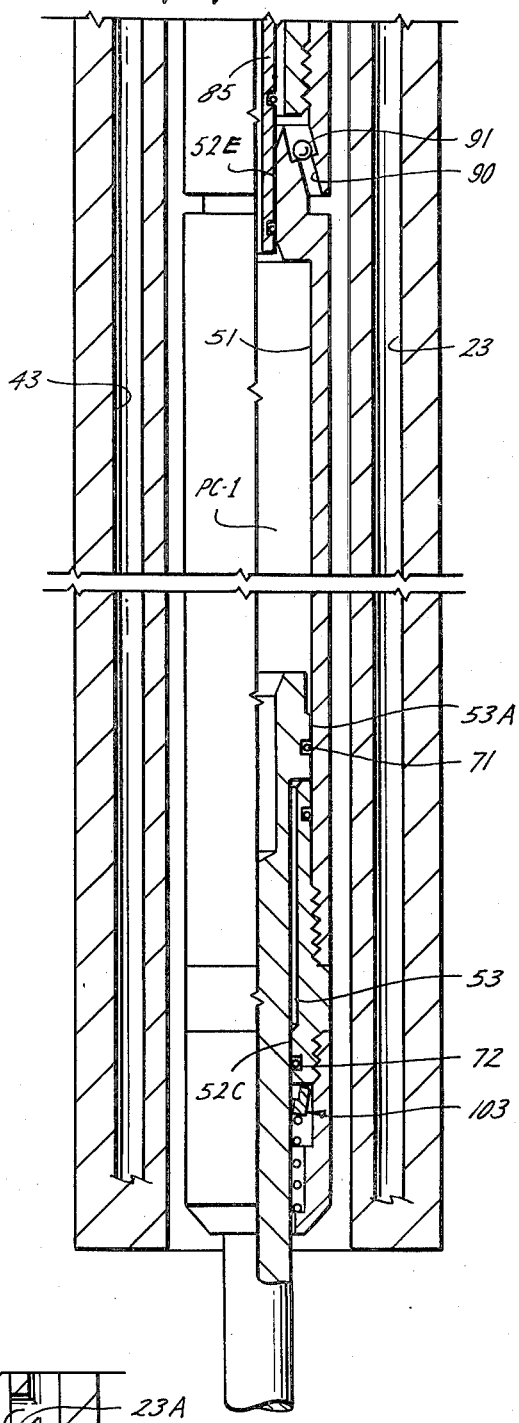

Upon movement of the rod 54 upwardly to the position of FIGS. 5A–5C, seal ring 63 maintains sealing engagement with the bore 52B of the main body, but seal ring 62A is raised above passageway portion 52A to open the lower end of chamber PC-2 to an annular passageway between the rod and bore portion 52A, and thus with a passageway 77 formed in a reduced passageway portion 52D of the body with which O-ring 84 on the rod sealably engages as the rod moves vertically. This latter seal is bypassed by passageway 77 which connects with ports 78 leading to the outer diameter of the body, and thus with an annular space between the body and the pocket 22 between upper and lower Chevron packings 79 and 80 carried about the body for sealably engaging the pocket. Ports 78 are thus fluidly connected to additional ports 81 formed in the body intermediate the packings and leading through ports 82 therein to an annular passageway 83 between the rod and bore of the main body. An O-ring 84 is carried by the rod for sealably engaging the reduced diameter portion 52D thereof through which passageway 77 is formed, and a port 84A is formed in a lower hollow portion 85 of the rod, to connect passageway 83 with the chamber PC-1.

Since the chamber PC-2 connects with chamber PC-1 only through a passageway which includes ports 78 and 81, and these ports connects with one another only when packings 79 and 80 are sealably engaged within pocket 22, or some other receiver, the plunger cannot be activated unless the tool LO is so arranged, even though the rod 53 might be released for extension, as by accidental displacement of the running tool RT. This then is a feature of the tool which renders it safe during storage and handling.

The alternative embodiment of FIG. 8 has a spacer ring 90 whose inner diameter is recessed to connect the lower end of passageway 77 with port 82. O-rings carried about the inner diameter of the ring 90 seal about the main portion of the body about which Chevron packings 79 and 80 are carried so that pressure fluid will flow from the chamber PC-2 into the chamber PC-1 even though the tool is not sealably packed off by means of Chevron packings 79 and 80 within the pocket of the mandrel. Hence, although this alternative tool does not have the safety features described in connection with the tool shown in FIGS. 4A–4C and 5A–5C, it nevertheless could be usable in an environment in which the tool was not necessarily packed off within a pocket or a receiver—i.e., in which the passageway interconnecting the reservoir of gas with the chamber PC-1 does not rely upon any portion of the annular space between the lock-open tool and the pocket.

The upper end of the plunger has an enlarged outer diameter portion 53A which carries an O-ring 71 for sealably sliding within an enlarged inner diameter portion of the chamber PC-1, and a reduced diameter portion 53B at its lower end which is sealably slidable within an O-ring 72 carried about a reduced diameter portion of the chamber. Thus, for reasons which will be more apparent from the description to follow, an annular chamber 73 is formed between the plunger and tool body to contain gas at atmospheric presusre. In its lower position, the lower hollow end of the rod 54 below port 84A fits within a recess 75 in the upper end of the plunger. In the lower position of the rod, O-ring 73 carried thereabout sealably engages with a reduced inner diameter portion 52E of the outer body beneath passageway 83, and O-ring 74 carried about the rod sealably engages the recess 75 within the upper end of the plunger. Thus, rings 71, 73 and 74 define another chamber 76 in which gas at atmospheric pressure may be contained.

A port 90 in the main body of the tool connects its exterior with the passageway 83 and thus with port 84A in the rod leading to chamber PC-1, whether rod 53 is raised or lowered, and thus whether or not chamber PC-2 is also connected with chamber PC-1. Port 90 is controlled by means of a check valve 91 which seats on the inner end of the port to permit the flow of ambient pressure into the passageway but, when seated, prevent flow from the passageway to the exterior of the tool. When the tool is in its inactive position, ambient pressure therefor has access through the passageway 83 and ports 84A into the chamber PC-1 intermediate the lower end of the rod and upper end of the plunger, so as to act downwardly on the plunger over the effective sealing area of O-ring 74. On the other hand, ambient pressure exerts an upward force on the plunger determined by the effective area of the seal ring 72 which is larger than that of the seal ring 74. Since this difference in areas (the annular pressure area between the seal rings 71 and 72) is acted upon by atmospheric pressure within the chamber 76, and the annular area between seal rings 71 and 72 is balanced by atmospheric pressure in both chambers 73 and 76, there is a resultant upward force which will maintain the plunger in its inactive position.

However, upon release of the running tool RT to permit the rod to rise, seal ring 62A will move above reduced bore portion 52A of the tool body to permit nitrogen or other pressurized gas in the chamber PC-2 to flow through the above described passageway and the port 84A into the chamber PC-1 and thus act downwardly on the plunger over an area defined by the O-ring 74. Depending on the relationship of the pressure of the contained gas to ambient pressure, the plunger will begin to move downwardly. In any event, upon further lifting of the rod, O-ring 74 will be raised above sealing engagement with recess 75 so as to open or vent the atmospheric chamber 76. As a result, the pressurized gas will act downwardly over a much larger area of the plunger defined by the effective sealing area of O-ring 71, thereby urging the plunger downwardly with an even larger force until the enlarged outer diameter on its upper end seats upon the upper end of the reduced bore portion 52C of the tool body.

The foregoing description assumes that the pressure contained in chamber PC-2 is higher than ambient pressure, in which case, when released from the chamber PC-2, will urge check valve 91 to seated position. However, even if ambient pressure is predominant, it will flow past check valve 91 so as to enter the chamber PC-1 and thus move the plunger 53 downwardly as the lower end of the rod moves upwardly to open the atmospheric chamber 76 and thus permit ambient pressure to act downwardly over the cross-sectional area of the plunger defined by seal ring 71. Thus, in this case, although ambient pressure is balanced across the effective sealing area of the O-ring 72, it nevertheless acts over an annular area defined between the O-ring 72 and the O-ring 71 which is opposed by only atmospheric pressure within the chamber 73. It will further be understood that if the contained pressure is predominant, the atmospheric pressure in chamber 73 will assist it in moving the plunger downwardly in that it is at a lower pressure than ambient pressure and thus provides a force on the plunger acting upwardly within atmospheric chamber 73 which is relatively small.

As shown in the drawings, all seal rings carried by the rod for sealably engaging with reduced bore portions of the body of the tool, as well as with the recess 75 of the plunger, in the inactive position of the tool, are of equal effective sealing area. As a result, the rod is pressure balanced in a vertical direction, so that there are no forces upon it which must be overcome in either assemblying the tool, and thus moving it into its lower position, or upon release of the running tool RT to permit the rod to move upwardly.

As previously described, in order to render the lock-open tool insensitive to control line pressure, at least some of the rings of Chevron packing 79 beneath port extension 23A face upwardly, and a Chevron packing 101 carried about the main body of the tool has at least some downwardly facing rings which seal with pocket 22 above such extension. Thus, control line pressure is blocked off from entry into the pressure chamber PC-1. Chevron packing 101 seals against the pocket below extension port 43A, and an additional Chevron packing 100 seals against the pocket above such extension so that with the rings thereof arranged as shown, tubing pressure beneath the safety valve, and thus within the equalizing passage 43, is also blocked off.

It may, however, be desirable, in some cases, to have a tool which is selectively actuated in response to control line pressure, as well as to one or both of a contained pressure source or ambient pressure. For example, both contained gas and the ambient pressure may be insufficient to actuate the tool, or the contained pressure, even though high enough to actuate the tool, may leak out of the chamber PC-2. For this purpose, in the modified tool of FIG. 7, the seal rings of the Chevron packing 79A face downwardly so that control line pressure within the passageway 23 may pass through the annular space between the tool and the pocket and through ports 81 and 82 into the passageway 83. In other respects, the alternate embodiment of the tool shown in FIG. 7 is, like that shown in FIG. 8, similar to the tool shown and described in connection with FIGS. 4A–4C and 5A–5C.

On course, upon activation of the tool, the fluid pressure admitted to chamber PC-1 to extend the plunger 53 to its active position would ordinarily be contained therein so as to continue to hold the plunger open. Furthermore, as previously described, even though a source of pressure greater than that of ambient pressure were to be lost, ambient pressure would nevertheless have access past check valve 91 to the chamber PC-1 above the plunger to maintain the plunger in its lowermost position. However, in order to avoid accidental retraction of the plunger for any other reason, a clutch 103 mounted within a recess about the lower end of the body is nevertheless provided for automatically locking the plunger in its extended position as it is moved into that position. Although other suitable clutch mechanisms may be used, the illustrated clutch comprises a ring 104 having an inner diameter somewhat larger than the outer diameter of the plunger and urged upwardly by means of a coil spring 105. The ring has a pin 106 on its upper side which, under the force of the spring 105, causes the ring to cock and thereby bind with the plunger to permit the plunger to move downwardly, but not upwardly.

As shown in FIGS. 4A–4C and 5A-5C, the effective sealing areas of the packings carried by the tool for sealing engagement with the pocket 22 are of equal area. Hence, since the pressure acting on the upper and lower ends of the landed tool is the same—namely, that within the tubing above the flapper 21 whether the tubing safety valve is open or closed, the tool is pressure balanced in a vertical direction, so that there are no forces tending to move it upwardly or downwardly when landed in the pocket.

It is believed that the use of the lock-open tool LO in connection with not only the tubing safety valve, but also in connection with the remainder of the well completion system shown in FIGS. 9 to 12 will be apparent to one skilled in the art, especially in view of the detailed description of the construction and operation of the tubing safety valve operning tool TSVO, the packer releasing tool PR, and the annular safety valve ASV and other cooperating parts of the system in one or more of my aforementioned copending patent applications. To summarize, however, and with reference to FIG. 9, the tubing string TS is shown lowered into the well bore WB and packed off above the production zone Z by means of packer P about its lower end. At this time, the packing element 27 and slip assembly 28 are retracted, and the means by which they are to be expanded is locked in an inoperative (non-expanding) position with respect to the tubular member 29 of the tubing hanger.

Figure 6:
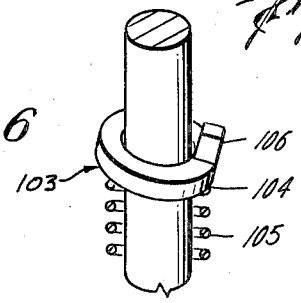
FIG. 6 is a perspective view of a clutch for holding the plunger of the tool extended.

The lock-open tool LO is lowered by wire line through the tubing string and into the upper end pocket 22 of the upper mandrel. When the tool is landed therein, and its running tool RT is released therefrom, as by an upper pull on the wire line, the plunger 53 of the tool is released to lower the flow tube 38 and thus move the flapper 21 of the tubing safety valve to the open position of FIG. 6. Tha packer releasing tool PR may have been in place in pocket 24 of lower mandrel LM at the time the tubing string is lowered, or, upon opening of the flapper 21, it may be lowered on a wire line into landed position within the pocket.

In any event, when so landed, tool PR connects the control line 23 with the tube 30 leading to passageway PW extending within the body means, which, when open, connects the tube 30 with the annulus beneath packing element 27. However, prior to the supply of control fluid through line 23, as well as through packer releasing tool PR, to the upper end of the passageway PW, it is closed by means of a piston 31 on the upper end of a sleeve 32 which, in the position shown diagrammatically in FIG. 9, holds the means for the packer expanding means in locked position.

Pressure fluid may be supplied through the line 23 and the tool PR into the upper end of the passageway so as to force the piston 31 downwardly and thus move the sleeve 32 to a position in which it releases the locking means between the sleeve 33 and the tubular member 28 of the tubing hanger TH. As a consequence, the sleeve 33 may be moved downwardly relative to the sleeve 34 in order to expand the packing element as well as the slip assembly 28 into engagement with the well bore, and the piston 31 is moved out of the passageway to open it as the packer is set. The sleeves are held in this retracted position so as to maintain the packer set by locking engagement of sleeve 33 to sleeve 34. As explained in my copending application Ser. No. 233,628, filed Feb. 17, 1981, and entitled "Flow Controlling Apparatus", release of the packer to be set in this manner—namely, by tubing pressure—enables the operator to pressure test the tubing, or pressure it up for other purposes, without also setting the packer. Consequently, the packer may instead be set by tubing pressure admitted to a pressure chamber thereof above piston 35 after it is unlocked.

Since the lock-open tool LO is moved into and held within a position opening the tubing safety valve irrespective of control fluid, the packer releasing tool PR may be retrieved, even though this opens the control line 23 through its connection to the pocket. Thus, as compared with the tubing safety valve operating tool TSVO, which would permit flapper 21 to close upon loss of control fluid, the tool LO will hold the tubing safety valve open and thus not cut the wire line or otherwise interfere with retrieval of the packer releasing tool, or its replacement with the annulus safety valve ASV which is now lowered through the tubing string and open tubing safety valve into a landed position within the pocket 24, as shown in FIG. 8.

Control fluid may then be supplied to the line 23 so as to open the annulus safety valve within the annulus safety valve tool ASV to connect ports leading from the pocket to the annulus above the packing element 27 with the tube 30 to establish circulation between the annulus above such packing element with the annulus below it through the open passageway PW. As previously described, gas may be circulated downwardly through the annulus and the packing element 27 and through the gas lift valve GLV into the tubing string, or other operations requiring circulation through the annulus above and below the packing element may be performed.

At this time, the lock-open tool may be retrieved from landed position within pocket 22, and the tubing safety valve operating tool TSVO lowered through the tubing string into landed position therein, as shown in FIG. 12. Of course, upon removal of the lock-open tool LO, the flapper 21 of the tubing safety valve automatically moves to the closed position of FIG. 12, and remains in this closed position until pressure fluid is supplied through the control line 23 in order to extend the plunger therefrom to again lower the flow tube 38 in order to move the tubing safety valve to open position. Simultaneously, of course, control fluid is supplied through the downward extension of the control line 23 to the annulus safety valve tool ASV in order to open the valve therein to connect the annulus above the packing element to the annulus below the packing element. Consequently, the well completion system may be prepared for safety control over both the tubing and the annulus in response to the supply through the single control line 23 of control fluid from a remote source.

Although the lock-open tool thus has particular utility in a tubing and annular safety valve completion system, as above described, it obviously has other uses in which operators are reluctant to conduct wire line operations through a tubing safety valve which is sensitive to control fluid, since the control fluid may be lost and permit the tubeing safety valve to automatically close.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Subsurface well apparatus, comprising body means disposable within a well bore and having a pressure chamber therein, an actuator sealably reciprocable within the chamber of the body means for shifting between an inner active and an outer active position, said actuator including a part which extends from the chamber so that ambient pressure is effective to urge said actuator to inactive position, means including a port in the body means to admit ambient pressure to the chamber so that ambient pressure urges said actuator to active position, a rod shiftable within the body means between first and second positions, said rod, in its first position, sealably engaging the actuator to define first effective pressure areas of the actuator which are responsive to ambient pressure within the chamber which are ineffective to move the actuator from its inactive position, and, in its second position, being withdrawn from sealing engagement with the actuator to expose second effective pressure areas of the actuator therein which are effective to move the actuator into its active position, means urging the rod toward its second position, means for holding said rod in its first position, and remotely operable means for releasing said hold means to permit said rod to be moved into its second position so that said actuator may be moved from inactive to active position.

2. Apparatus of the character defined in claim 1, wherein the inner end of the actuator has an inwardly extending recess, the rod is slidable within the body means between its first position fitting within the recess when the actuator is in inactive position and its second position removed from within said recess when the actuator is in active position, first and second means seal between respectively larger and smaller diameter portions of the actuator and the body means to define a first atmospheric chamber therebetween, third means which seal between the rod and a diameter portion of the recess which is smaller than the second seal means, and additional means seals between the rod and body means to define another atmospheric chamber between the body means, rod and actuator, movement of the rod toward its second position withdrawing the third sealing means from the actuator recess to open said atmospheric chamber to the pressure chamber.

3. Apparatus of the character defined in claim 1, including clutch means for automatically holding said actuator against return to its inactive position in response to movement to its active position.

4. Apparatus of the character defined in claim 1, wherein a means is provided for urging the rod to its second position, and a part is releasably connected to the body means in position to engage and hold said rod in its first position until released from the body means.

5. Apparatus of the character defined in claim 4, wherein said part is a tool which is run on a wire line and which is shearably connected to the body means.

6. Apparatus of the character defined in claim 1, wherein a spring within an annular space between the rod and body means urges the rod to its second position.

7. Apparatus of the character defined in claim 6, wherein the rod is sealably engaged with the body means along equal areas at each end so that it is pressure balanced with respect to the same ambient pressure acting over both such ends.

8. Apparatus of the character defined in claim 1, wherein the body means includes an outer body having a pocket to which control fluid may be admitted through a port leading into the pocket, a tool in which the actuator, the pressure chamber and rod are carried and which may be received in the pocket, and a pair of packings are carried about the tool for sealing with the pocket on both sides of the port.

9. Apparatus of the character defined in claim 8, wherein the tool has a passageway therein which connects the ambient pressure admitting port with the pressure chamber therein and the exterior of the tool intermediate one of the packings, and a third packing carried about the tool for sealing with the pocket near one of the pair of packings, and said one packing permits control fluid to flow therepast into the passageway.

10. Apparatus of the character defined in claim 1, wherein the body means has a second pressure chamber therein in which a source of pressure fluid is contained, and a passageway for connecting the first and second chambers, said rod carries means to close the passageway in its first position and open the passageway in its second position, and a valve in the port closes it when the source of fluid in the second chamber is at a higher pressure than ambient.

11. Apparatus of the character defined in claim 10, wherein the body means comprises an outer body having a pocket therein, and a tool in which said actuator, pressure chambers and rod are carried which is received in the pocket, first and second packings are carried about the tool for sealing with the pocket, and a portion of the passageway in the tool connects with the exterior of the tool intermediate the packings.

12. Apparatus of the character defined in claim 11, wherein a third packing is carried about the tool near the first packing, a port in the body means leads from a source of control fluid to connect with the pocket intermediate the first and third packings, and said first packing prevents flow of control fluid into the passageway.

13. Apparatus of the character defined in claim 11, wherein a third packing is carried about the tool near the first packing, a port in the body means leads from a source of control fluid to connect with the pocket intermediate the first and third packings, and said first packing permits flow of control fluid into the passageway.

14. Apparatus of the character defined in claim 10, wherein the body means comprises an outer body having a pocket therein and a tool in which said pressure chambers and rod are carried and which is received within the pocket, first and second packings are carried about the tool for sealing with the pocket, and a portion of the passageway in the tool has lateral extensions which are formed in an inner portion of the body and connected to one another by a ring which is disposed between the packings about said inner portion.

15. Apparatus of the character defined in claim 10, wherein a means is provided for urging the rod to its second position, and a part is releasably connected to the body means in position to engage and hold the rod in its first position until released from the body means.

16. Apparatus of the character defined in claim 15, wherein said part is a tool which is run on a wire line and which is shearably connected to the body means.

17. For use with a subsurface tubing safety valve which comprises a mandrel having a bore therethrough connected in axial alignment with the bore of a tubing string, a closure member mounted on the mandrel for movement between positions opening and closing the bore, means yieldably urging the closure member to its closed position, a pocket to one side of the bore having an end which opens to the bore, and a tool adapted to be moved vertically through the tubing string and open end of the pocket into and out of a landed position within the pocket, and including means which is responsive to the supply of control fluid to said pocket from a remote source, when landed in said pocket, in order to move the closure member to open position; apparatus comprising another tool which is also adapted to be moved vertically through said tubing string and open end of the pocket into and out of landed position within said pocket, prior to landing of said first-mentioned tool therein or upon removal of said first-mentioned tool therefrom, said other tool having means which is remotely operable, when so landed, to move said closure member to open position and hold it in open position irrespective of said control fluid.

18. The apparatus of claim 17, wherein the means for moving and holding the closure member open is fluid pressure responsive.

19. The apparatus of claim 18, wherein the fluid pressure is a source contained under pressure within the tool.

20. The apparatus of claim 18, wherein the fluid pressure is ambient fluid.

21. The apparatus of claim 18, wherein the fluid pressure is either or both of a source contained under pressure within the tool and ambient fluid.

22. The apparatus of claim 17, wherein control fluid is supplied to the pressure responsive means through a control line leading from a remote source.

23. In a subsurface tubing safety valve which comprises a mandrel having a bore therethrough adapted to be connected in axial alignment with the bore of a tubing string, a closure member mounted on the mandrel for movement between positions opening and closing the bore, means yieldably urging the closure member to its closed position, and a pocket to one side of the bore having an end which opens to the bore to enable a tool to be moved vertically through the tubing string and open end of the pocket into and out of a landed position within the pocket, whereby control fluid from a remote source may be supplied to pressure responsive means in the tool in order to move the closure member to open position; the improvement comprising another tool which may also be moved vertically through said tubing string and open end of the pocket into and out of landed position within said pocket, prior to landing of said first-mentioned tool thereon or upon removal of said first-mentioned tool therefrom, said other tool having means which is remotely operable, when so landed, to move said closure member to open position and hold it in open position irrespective of said control fluid.

24. The improvement of claim 23, wherein the means for moving and holding the closure member open is fluid pressure responsive.

25. The improvement of claim 24, wherein the fluid pressure is a source contained under pressure within the tool.

26. The improvement of claim 24, wherein the fluid pressure is ambient fluid.

27. The improvement of claim 24, wherein the fluid pressure is either or both of a source contained under pressure within the tool and ambient fluid.

28. The improvement of claim 23, wherein control fluid is supplied to the pressure responsive means through a control line leading from a remote source.

29. For use with a subsurface tubing safety valve which comprises a mandrel having a bore therethrough connected in axial alignment with the bore of a tubing string, a closure member mounted on the mandrel for movement between positions opening and closing the bore, means yieldably urging the closure member to its closed position, a pocket to one side of the bore having an end which opens to the bore, and a tool adapted to be moved vertically through the tubing string and open end of the pocket into and out of a landed position within the pocket, and including means which is responsive to the supply of control fluid to said pocket from a remote source, when landed in said pocket, in order to move the closure member to open position; apparatus comprising another tool which is also adapted to be moved vertically through said tubing string and open end of the pocket into and out of landed position within said pocket, prior to landing of said first-mentioned tool therein or upon removal of said first-mentioned tool therefrom, said other tool having means which is remotely operable, when so landed, to move said closure member to open position and hold it in open position in response to a source of pressure fluid contained in said other tool, and thus irrespective of control fluid, or alternatively, to the supply thereto of said control fluid from said remote source.

30. For use with a subsurface tubing safety valve which comprises a mandrel having a bore therethrough connected in axial alignment with the bore of a tubing string, a closure member mounted on the mandrel for movement between positions opening and closing the bore, means yieldably urging the closure member to its closed position, a pocket to one side of the bore having an end which opens to the bore, and a tool adapted to be moved vertically through the tubing string and open end of the pocket into and out of a landed position within the pocket, and including means which is responsive to the supply of control fluid to said pocket from a remote source, when landed in said pocket, in order to move the closure member to open position; apparatus comprising another tool which is also adapted to be moved vertically through said tubing string and open end of the pocket into and out of landed position within said pocket, prior to landing of said first-mentioned tool therein or upon removal of said first-mentioned tool therefrom, said other tool having means which is remotely operable, when so landed, to move said closure member to open position and hold it in open position in response to ambient pressure within the well bore, or, alternatively, to the supply of said control fluid from said remote source.

31. Apparatus of the character defined in claim 30, wherein said ambient fluid is within the tubing string.

32. Apparatus of the character defined in claim 30, wherein the means of said other tool for so moving and holding the closure member is also responsive to a source of pressure fluid contained in said other tool.

33. Apparatus for use in controlling flow through a tubing string as well as through the annulus between the tubing string and the well bore in which it is suspended, comprising body means having a bore therethrough adapted to be connected in axial alignment with the tubing string, a packing element about the body means, means for expanding the packing element into engagement with the well bore in order to close off the annulus, means for releasably locking the expanding means in a position in which the packing element may retract, whereby the packing element may be expanded, a closure member for opening and closing the bore of the tubing and string and normally urged to closed position, means including a passageway in the body means for connecting the annulus above and below the packing element, when expanded, said body means having upper and lower pockets to one side of the bore therethrough, each pocket having an end which opens to the bore, means by which control fluid from a remote source may be supplied to each pocket, a first tool adapted to be moved vertically through the tubing string into and out of landed position within the upper pocket and having means for moving the closure member into open position and holding it in open position, a second tool adapted to be moved vertically through the tubing string into a landed position within the lower pocket and having means which is responsive to the supply of control fluid thereto in order to cause release of the packing element locking means, whereby the packing element may be expanded, said second tool being retrievable from landed position within the lower pocket and through the held open tubing bore closure member after setting of the packing element, a third tool adapted to be moved vertically through the tubing string and the open closure member into a landed position within the lower pocket, upon removal of the second tool therefrom, and having means which is response to the supply of control fluid thereto to establish circulation through said connecting means between the annulus above and below the packing, said first tool being retrievable from landed position within the upper pocket, the means for moving and holding said first tool in open position being irrespective of control fluid, so that said closure member will be held open as said second tool is retrieved and said third tool is landed, and a fourth tool adapted to be moved vertically through the tubing string and into a landed position within the upper pocket, and having means which is responsive to the supply of control fluid thereto in order to move the closure member to open position, the fluid responsive means of said third tool being responsive to the loss of control fluid to close circulation through said connecting means and the fluid responsive means of said fourth tool being responsive thereto to permit said closure member to move to closed position.

34. Apparatus of the character defined in claim 33, wherein the means for releasing the locking means includes a piston for closing the passageway which, upon movement to releasing position, and setting of said packing element, is removed from said passageway.

35. Apparatus of the character defined in claim 33, wherein control fluid is supplied from said source to each of said tools through a single line.

36. Apparatus of the character defined in claim 33, wherein the means of said first tool for moving and holding the closure member is fluid pressure responsive.

37. Apparatus of the character defined in claim 36, wherein the fluid pressure is a source contained under pressure within the tool.

38. Apparatus of the character defined in claim 36, wherein the fluid pressure is ambient fluid.

39. Apparatus of the character defined in claim 36, wherein the fluid pressure is either or both of a source contained under pressure within the tool and ambient fluid.

40. Apparatus of the character defined in claim 33, wherein each of said first and fourth tools includes a plunger which is extendible to move and hold the closure member open.

41. Apparatus of the character defined in claim 33, wherein the body means includes portions having outer diameters which are eccentric to the bore therethrough to form a thickened wall portion on one side of the bore, and each pocket is formed in a thickened wall portion.

42. Subsurface well apparatus, comprising body means disposable within a well bore and having first and second pressure chambers therein, an actuator having a pressure responsive member sealably reciprocable within the first chamber for shifting the actuator between inactive and active positions, a source of fluid contained within the second chamber, a passageway connecting said first and second chambers, valve means shiftable within the body means between a first position closing the passageway and a second position opening the passageway so that pressure fluid from said source is effective to urge said actuator from normally inactive to active position, and means for causing the valve means to shift from its first to its second position, including means urging said valve means toward its second position, means releasably connected to said body for holding said valve means in its first position, and remotely operable means for releasing the connection of said holding means to said body means to permit the valve means to be moved into its second position.

43. Apparatus of the character defined in claim 42, wherein said holding means comprises a wire line tool which is releasably connected to the body means to permit the body means to be lowered therewith into its landed position within the well bore while holding said valve means in the first position.

44. Apparatus of the character defined in claim 42, including means for holding said actuator in active position independently of said source of fluid and automatically in response to movement thereof to active position.

45. A subsurface well tool, comprising a body adapted to be lowered into a landed position within a receiver within a well bore and having first and second pressure chambers therein, an actuator having a pressure responsive member sealably reciprocable within the first chamber for shifting the actuator between inactive and active positions, a source of fluid contained within the second chamber, means including a passageway within the tool body connecting said first and second chambers when said body is landed within the receiver, valve means shiftable within the body between a first position closing the passageway and a second position opening the passageway so that pressure fluid from said source is effective to urge said actuator from normally inactive to active position, means adapted to be remotely operated, upon landing of the tool, for causing the valve means to shift from its first to its second position, and a pair of packings carried about the body for sealing with the receiver, a portion of said passageway connecting with the exterior of the tool body intermediate the pair of packings, whereby said source of fluid is not admitted to the second chamber to move the actuator to active position until said tool body is so landed.

46. Apparatus of the character as defined in claim 45, including means for holding said actuator in active position independently of said source of fluid and automatically in response to movement of the actuator to active position.

47. Apparatus of the character defined in claim 45, wherein a third packing is carried about the tool body nearer one packing of the pair of packings than the other, whereby the third and one packing are located above and below a port in the receiver for connection with a remote source of control fluid, when the tool body is so landed, and said one packing prevents flow of control fluid into the passageway.

48. Apparatus of the character defined in claim 45, wherein a third packing is carried about the tool body nearer one packing of the pair of packings than the other, whereby the third and one packer are located above and below a port in the receiver for connection with a remote source of control fluid, when the body is so landed, and said one packing permits flow of control fluid into the passageway.

49. Subsurface well apparatus, comprising body means disposable within a well bore and having first and second pressure chambers therein, an actuator having a pressure responsive member sealably reciprocable within the first chamber for shifting the actuator between inactive and active position, a source of fluid contained within the second chamber, a passageway connecting said first and second chambers, valve means shiftable within the body means between a first position closing the passageway and a second position opening the passageway so that pressure fluid from said source is effective to urge said actuator from normally inactive to active position, means for shifting the valve means from its first to its second position, and means for admitting ambient pressure to the second chamber, when said ambient pressure is higher than that of the said source of fluid.

50. Apparatus of the character defined in claim 49, including means for admitting fluid from a remote source to the second chamber when the pressure of said remote source of fluid is higher than that of the contained source or ambient pressure.

51. Subsurface well apparatus, comprising body means disposable within a well bore and having first and second pressure chambers therein, an actuator having a pressure responsive member sealably reciprocable within the first chamber for shifting the actuator between inactive and active positions, a source of fluid contained within the second chamber, a passageway connecting said first and second chambers, valve means shiftable within the body means between a first position closing the passageway and a second position opening the passageway so that fluid from said source is effective to urge said actuator from normally inactive to active position, and means for causing the valve means to shift from its first to its second position, and means for admitting fluid from a remote source to the second chamber, when the pressure of said remote source of fluid is higher than that of the source contained in the tool.

52. Subsurface well apparatus, comprising body means disposable within a well bore and having first and second pressure chambers therein, an actuator reciprocable within the first chamber between inactive and active positions, a source of fluid contained within the second chamber, a passageway connecting said first and second chambers, valve means shiftable within the body means between a first position closing the passageway and a second position opening the passageway, and means for shifting the valve means from its first to its second position, said actuator member extending from the chamber to provide a first pressure responsive area which is acted upon by ambient pressure to hold the actuator inactive position, when the valve means is in the first position, and said pressure responsive member of the actuator having a second pressure responsive area which is acted upon by said source of fluid to move the actuator to active position when said valve means is in the second position.

53. Apparatus of the character described in claim 52, including means for admitting ambient pressure to said second chamber when it is greater than the pressure of said source.

54. Subsurface well apparatus, comprising body means disposable within a well bore and having first and second pressure chambers therein, an actuator having a pressure responsive member sealably reciprocable within the first chamber for shifting the actuator between inactive and active positions, a source of fluid contained with the second chamber, a passageway connecting said first and second chambers, valve means shiftable within the body means between a first position closing the passageway and a second position opening the passageway so that pressure fluid from said source is effective to urge said actuator from normally inactive to active position, remotely operable means for causing valve means to shift form its first to its second position, and means for holding said actuator in its active position independently of said source of pressure fluid and automatically in response to movement of the actuator into active position.

55. Apparatus of the character described in claim 54, wherein said holding means including clutch means automatically responsive to movement of the actuator to active position for engaging said actuator to hold it against return to its active position.

56. Subsurface well apparatus, comprising body means disposable within a well bore and having a pressure chamber therein, an actuator sealably reciprocable within the chamber of the body means for shifting between an inner inactive and outer active position, said actuator having a part extending from the chamber over which ambient pressure is effective to urge it to inactive position, means including a port in the body means to admit ambient pressure to the chamber to urge the actuator to active position, means shiftable within the body means between a first position in which ambient pressure acting upon said part and within said chamber is effective to hold the actuator in its inactive position, and a second position in which it is effective to move the actuator into its active position, means urging the shifting means toward its second position, means for holding the shifting means in its first position, and remotely operable means for releasing said holding means to permit said shifting means to be moved into its second position so that said actuator may be moved from inactive to active position.

57. Apparatus of the character defined in claim 56, including means for automatically holding said actuator against return to its inactive position in response to movement to its active position.

58. Apparatus of the character defined in claim 56, wherein said holding means is a tool which is run on a wire line and which is shearably connected to the body means.

59. Apparatus of the character defined in claim 56, wherein the shifting means is sealably engaged with the body means along equal areas at each end so that it is pressure balanced with respect to ambient pressure acting over both such ends.

60. Apparatus of the character defined in claim 56, wherein the body means includes a receiver to which control fluid may be admitted through a side port, and a toll in which the actuator, the pressure chamber and shifting means are carried and which may be received in the receiver, and a pair of packings carried about the tool for sealing with the receiver on both sides of the port when the tool is so received.

61. Apparatus of the character defined in claim 56, wherein the body means has a second pressure chamber therein in which a source of pressure fluid is contained, and a passageway for connecting the first and second chambers, said shiftable means closes the passageway in its first position and opens the passageway in its second position, and a valve in the port closes it when the source of fluid in the second chamber is at a higher pressure than ambient.

62. Apparatus of the character defined in claim 61, wherein the body means comprises a receiver, and a tool in which said actuator, pressure chambers and rod are carried which is received in the receiver, first and second packings are carried about the tool for sealing with the receptacle, and a portion of the passageway in the tool connects with the exterior of the tool intermediate the packings.

63. Apparatus of the character defined in claim 61, wherein said holding means is a tool which is run on a wire line and which is shearably connected to the body means.

64. For use with a subsurface tubing safety valve which comprises a mandrel having a bore therethrough connected in axial alignment with the bore of a tubing string, a closure member mounted on the mandrel for movement between positions opening and closing the bore, means yieldably urging the closure member to is closed position, a pocket to one side of the bore having an end which opens to the bore, and a tool adapted to be moved vertically through the tubing string and open end of the pocket into and out of a landed position within the pocket, and including means which is responsive to the supply of control fluid to said pocket from a remote source, when landed in said pocket, in order to move the closure member to open position; apparatus comprising another tool which is also adapted to be moved vertically through said tubing string and open end of the pocket into and out of landed position within said pocket, prior to landing of said first-mentioned tool therein or upon removal of said first-mentioned tool therefrom, said other tool having means which is remotely operable, when so landed, to move said closure member to open position in response to the supply thereto of said control fluid from said remote source, and additional means for holding said closure member in open position irrespective of said control fluid.

* * * * *